US007758159B2

(12) United States Patent
Onozawa

(10) Patent No.: US 7,758,159 B2
(45) Date of Patent: Jul. 20, 2010

(54) MIST SPRAYING APPARATUS AND IMAGE FORMING APPARATUS

(75) Inventor: Sho Onozawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 951 days.

(21) Appl. No.: 11/546,409

(22) Filed: Oct. 12, 2006

(65) Prior Publication Data

US 2007/0091148 A1 Apr. 26, 2007

(30) Foreign Application Priority Data

Oct. 14, 2005 (JP) ..... 2005-300455

(51) Int. Cl.
*B41J 2/135* (2006.01)
*B41J 2/05* (2006.01)

(52) U.S. Cl. ..... 347/46; 347/67

(58) Field of Classification Search ..... 347/46, 347/67, 44, 47

See application file for complete search history.

(56) References Cited

U.S. PATENT DOCUMENTS 5,565,113 A * 10/1996 Hadimioglu et al. ..... 216/2
5,975,683 A * 11/1999 Smith et al. ..... 347/55
6,371,598 B1 4/2002 Fujii et al.
2002/0063751 A1 5/2002 Aizawa et al.

FOREIGN PATENT DOCUMENTS

| | | | |
|---|---|---|---|
| JP | 62-85948 | A | 4/1987 |
| JP | 62-111757 | A | 5/1987 |
| JP | 2-134250 | A | 5/1990 |
| JP | 5-57891 | A | 3/1993 |
| JP | 2002-59549 | A | 2/2002 |
| JP | 2002-166541 | A | 6/2002 |

OTHER PUBLICATIONS

Shumpei Kameyama et al., Journal of the Acoustical Society of Japan, vol. 60, No. 2, pp. 53-60, (2004).

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

The mist spraying apparatus includes: a liquid chamber filled with liquid; a mesh member which is disposed on a liquid ejection side of the liquid chamber, has a net shape, and retains a free surface of the liquid filled in the liquid chamber, the mesh member including an intersection point to form the net shape; and an ultrasonic wave generating device which is disposed at a position opposing the intersection point of the mesh member and emits an ultrasonic wave into the liquid.

12 Claims, 9 Drawing Sheets

MIST SPRAYING APPARATUS AND IMAGE FORMING APPARATUS

BACKGROUND OF THE INVENTION

1. Field of the Invention

The present invention relates to a mist spraying apparatus and an image forming apparatus, and more particularly, to an apparatus which converts a liquid into a mist and sprays the mist by using an ultrasonic wave, and an image forming apparatus which records an image by means of a group of minute liquid droplets (mist cluster) sprayed as a mist.

2. Description of the Related Art

In the related art, Japanese Patent Application Publications No. 62-85948, No. 62-111757, No. 2-134250, No. 5-57891, No. 2002-59549 and No. 2002-166541 disclose ejection technology based on a mist system in which minute liquid droplets are ejected in a group (cluster) by using ultrasonic wave vibration. Furthermore, there is a non-patent reference, "Investigation into ink droplet ejection in print head using concentrated ultrasonic wave and nozzle", (Shumpei Kameyama, et. al., Journal of the Acoustical Society of Japan, Vol. 60, No. 2, pp. 53-60, 2004) which relates to the basic structure and ejection mechanism disclosed in Japanese Patent Application Publications No. 2002-59549 and No. 2002-166541.

FIG. 9 is a plan diagram of a nozzle surface in a mist type head in the related art, and FIG. 10 is a cross-sectional diagram showing the composition of a liquid droplet ejection element corresponding to one nozzle (one channel). As shown in FIG. 9, a mist spray head 200 in the related art comprises a nozzle plate 212 having ejection openings (nozzle holes) 210. A diaphragm 214 and piezoelectric elements (vibrators) 216 are disposed to the rear of the nozzle plate 212 (the lower side in FIG. 10). The space between the diaphragm 214 and the nozzle plate 212 is filled with ink.

The piezoelectric elements (vibrators) 216 bonded to the diaphragm 214 each comprise a common electrode 218, a piezoelectric body 219 and an individual electrode 220. When a drive voltage is applied between the two electrodes, the piezoelectric element 216 vibrates and applies a planar wave from below toward a free surface (which is commonly called "meniscus") of the liquid at a nozzle hole 210, thereby inducing a surface tension wave (capillary wave) due to the particular characteristics (surface friction, etc.) of a nozzle edge 222. Moreover, if the frequency of the planar wave and the onset amplitude at the meniscus satisfy prescribed conditions which is dependant on the properties of the liquid, then time series oscillation of the surface tension wave occurs. Consequently, at a certain time point, minute liquid droplets 226 break off from wave peaks of the surface tension wave 224. The topics described above describe the mechanism of creating a capillary mist.

However, in the mist method based on the related art, there are the problems described below.

At first, the ejection direction varies and the dot diameter expands, because of variations in the accuracy of the shape of the nozzle edge, Coulomb repulsive force between minute liquid droplets, and the like.

Secondly, there is a problem of variation in the size of the liquid droplets. Since minute droplets are ejected from the free surface of liquid inside the nozzle in accordance with the stochastic distribution of the surface energy, the droplet size depends on the stochastic distribution of the surface energy. Thus, according to the related art, it is difficult to achieve a uniform droplet size. Moreover, if a nozzle is an ideal circular nozzle having axial symmetry, the stochastic distribution of the surface energy has axial symmetry and the cluster of liquid droplets is theoretically ejected from the nozzle in the torus fashion. However, in the actual practice, it is inferred that the creation of a mist is due principally to the occurrence of an axial asymmetry of the stochastic distribution of the surface energy which is dependent on the probabilistic broken symmetry of the nozzle, and the like. Since the probabilistic broken symmetry of the nozzle is not an available parameter, then it is difficult to control the size of liquid droplets. In this way, in a mist system in the related art, there is a problem of variation in the size of the liquid droplets.

Thirdly, due to the combination of variation in the ejection direction and the liquid droplet size as described above, there is density non-uniformity in dots formed by a mist cluster which has been deposited on an ejection receiving medium.

Finally, the head has poor characteristics for removing air bubbles because of the sealed structure thereof.

SUMMARY OF THE INVENTION

The present invention has been contrived in view of the foregoing circumstances, an object thereof being to resolve the problems described above and to provide a mist spraying apparatus having a high-density spraying unit and an image forming apparatus using same.

In order to attain the aforementioned object, the present invention is directed to a mist spraying apparatus, comprising: a liquid chamber filled with liquid; a mesh member which is disposed on a liquid ejection side of the liquid chamber, has a net shape, and retains a free surface of the liquid filled in the liquid chamber, the mesh member including an intersection point to form the net shape; and an ultrasonic wave generating device which is disposed at a position opposing the intersection point of the mesh member and emits an ultrasonic wave into the liquid.

According to this aspect of the present invention, by means of the ultrasonic wave striking the intersection point of the mesh member, a surface tension wave is generated in the vicinity of the intersection point. A mist (minute liquid droplets in the form of a mist) is thus ejected by causing the surface tension wave to oscillate. Since the ejection region of the composition based on the present invention has a closed structure (the intersection point of the mesh member), rather than an open structure (for example, a circular nozzle hole in the related art), then it is possible to reduce variation in the ejection direction (flight direction) compared to the related art, thereby suppressing enlargement of the dot diameter due to such variation in the ejection direction. Hence the mist can be formed accurately.

Moreover, in the case of a circular nozzle in the related art, the vibration region of each nozzle is divided into divisions depending on a mode of a distance (r) from the center and a mode of an angle (θ) in the circumferential direction, the vibration region area in a nozzle surface becomes non-uniform, and hence non-uniformity in the size of the liquid droplets may occur. On the other hand, in the composition in which the liquid is ejected from the intersection point in the present invention, such non-uniformity in the size of the liquid droplets does not occur, and hence the size of the liquid droplets can be made uniform.

Further, due to the combined effects of suppressing variation in the ejection direction and enlargement of the dot diameter and achieving uniform liquid droplet size, it is possible to achieve uniform density within the dots.

Furthermore, in the mist spraying apparatus based on the present invention, since the free liquid surface at the ejection surface is supported by the mesh member, then the liquid chamber has a relatively unenclosed structure compared to a case of a nozzle plate in the related art, and hence the air bubble removal properties are excellent.

According to the present invention, in addition to the benefits described above, various modes can be employed as the net shape of the mesh member, and it is possible to achieve a high density of intersection points which functions as ejection points. Thus, the present invention can be applied to a mist spraying apparatus including high-density ejection elements.

Preferably, the mist spraying apparatus further comprises: a rear surface electrode which supports an ejection receiving medium onto which the liquid in a form of a mist is ejected from the intersection point of the mesh member; and a voltage application device which generates an electric field to accelerate the liquid in a form of a mist toward the ejection receiving medium, in a space between the mesh member and the rear surface electrode.

According to this aspect of the present invention, the charged mist sprayed from the intersection point of the mesh member is accelerated by the electrostatic force due to the electric field applied between the rear surface electrode and the mesh member, and is disposed onto the ejection receiving medium.

In order to attain the aforementioned object, the present invention is also directed to an image forming apparatus comprising one of the mist spraying apparatuses described above, wherein an image is formed on an ejection receiving medium by means of the liquid ejected from the intersection point of the mesh member.

According to this aspect of the present invention, the driving of the ultrasonic wave generating device is controlled according to an input image data, and liquid droplets in the form of a mist are ejected accordingly from the intersection point of the mesh member. The cluster of the ejected mist is deposited on the ejection receiving medium, thus forming dots. By controlling the ejection timing and the ejection volume of the liquid droplets in accordance with the image data, it is possible to record a desired image (dot arrangement) on the ejection receiving medium. Consequently, the image formation with a high quality and a high speed is achieved according to the image forming apparatus of the present invention.

In order to achieve a high-resolution image output, it is preferable to adopt a mist ejection head in which a plurality of ejection elements each of which includes an intersection point of the mesh member forming an ejection point (hereinafter, also referred to as "ejection intersection point") and an ultrasonic wave generating device disposed so as to correspond to the ejection intersection point, are arranged.

For the above mist ejection head, it is possible to use, for example, a mist ejection head of full line type having an ejection intersection point row in which a plurality of ejection intersection points are arranged through a length corresponding to the full width of an ejection receiving medium.

In this case, a mode may be adopted in which a plurality of relatively short ejection head modules each of which includes an ejection intersection point row which does not reach a length corresponding to the full width of an ejection receiving medium are combined and joined together, thereby forming an ejection intersection point row of a length that corresponds to the full width of the ejection receiving medium.

Although a mist ejection head of full line type is usually disposed in a direction that is perpendicular to the relative feed direction (relative conveyance direction) of a recording medium (ejection receiving medium), a mode may also be adopted in which the mist ejection head is disposed following an oblique direction that forms a prescribed angle with respect to the direction perpendicular to the conveyance direction.

Moreover, the term "ejection receiving medium" denotes a recording medium, print medium, image forming medium, image receiving medium, or the like. This term includes various types of media, irrespective of the material and size, such as a continuous paper, a cut paper, a sealed paper, a resin sheet such as OHP sheet, a film, a cloth, a printed circuit board on which a wiring pattern, or the like, is formed, and an intermediate transfer medium.

The conveyance device which relatively moves the ejection receiving medium and the mist ejection head may adopt a mode where the ejection receiving medium is conveyed with respect to the stationary (fixed) head, a mode where the head is moved with respect to the stationary ejection receiving medium, or a mode where both the head and the ejection receiving medium are moved.

According to the present invention, it is possible to suppress variation in the ejection direction and enlargement of the dot diameter, and to achieve uniform size of the liquid droplets, uniform density within the dots, the good air bubble removal characteristics, higher density of the ejection elements, and the like.

BRIEF DESCRIPTION OF THE DRAWINGS

The nature of this invention, as well as other objects and benefits thereof, is explained in the following with reference to the accompanying drawings, in which like reference characters designate the same or similar parts throughout the figures and wherein.

DETAILED DESCRIPTION OF THE PREFERRED EMBODIMENTS

Figure 1:
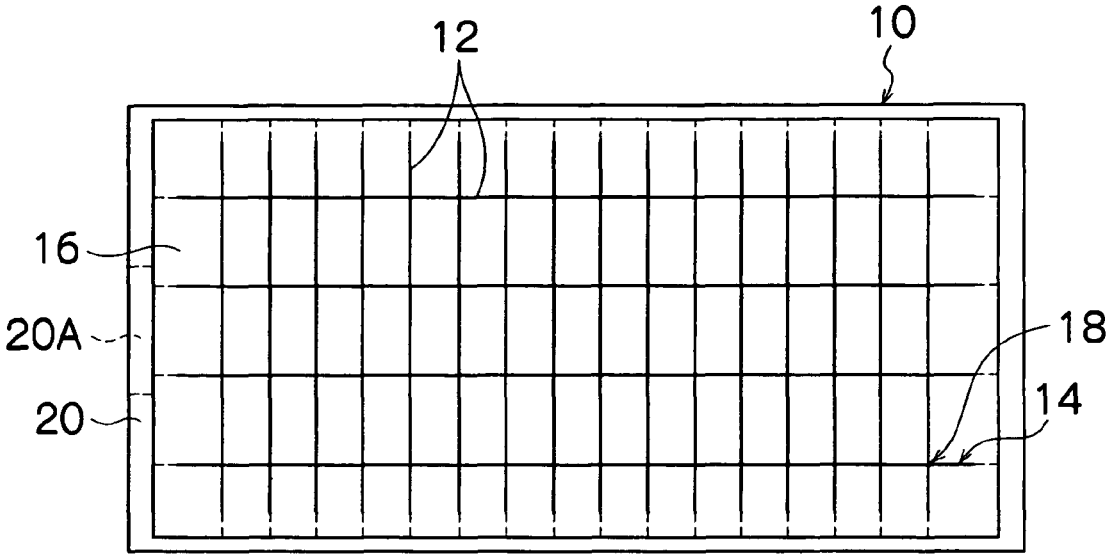
FIG. 1 is a plan diagram showing a composition of a mist ejection head based on an embodiment of the present invention.
Figure 9:
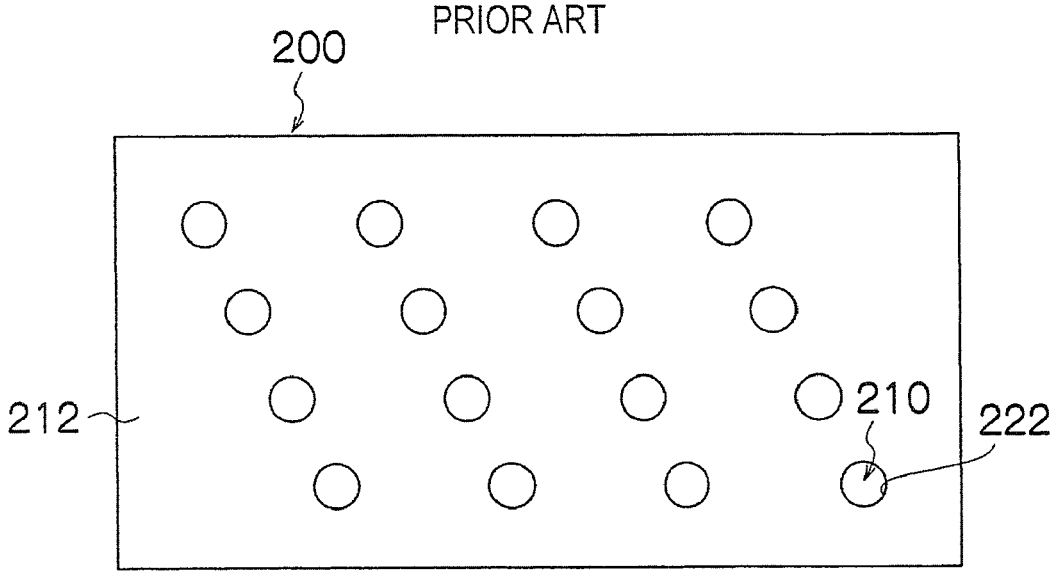
FIG.9 PRIOR ART
FIG. 9 is a plan diagram showing the ejection surface of a mist ejection head based on the related art.
Figure 10:
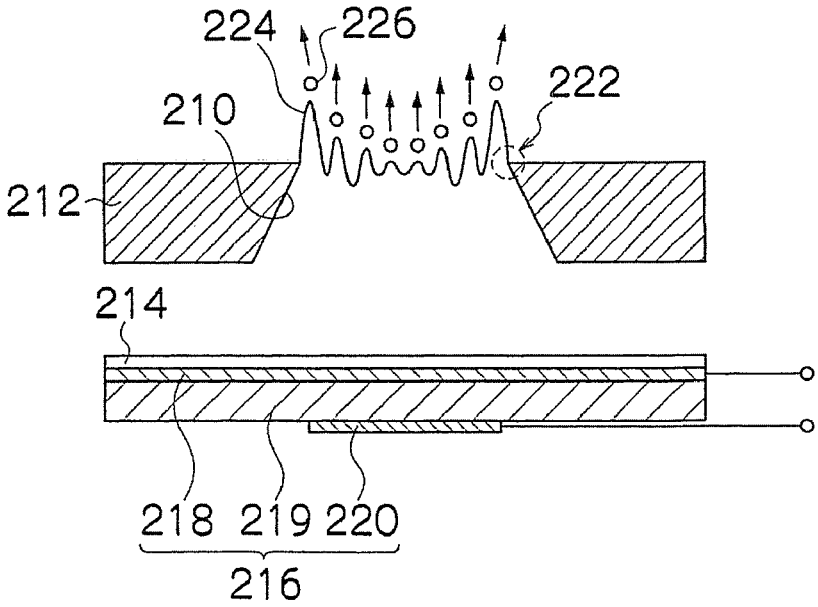
FIG.10 PRIOR ART
FIG. 10 is a cross-sectional diagram showing a liquid droplet ejection element for one channel in a mist ejection head based on the related art.

FIG. 1 is a plan diagram showing a composition of a mist spraying apparatus relating to an embodiment of the present invention. The mist type head in the related art described with reference to FIGS. 9 and 10 has a nozzle plate having a plurality of nozzle holes for ejection. On the other hand, the mist ejection head 10 in the embodiment of the present invention shown in FIG. 1 comprises, instead of the nozzle plate, a wire matrix 14 (corresponding to a "mesh member") constituted by combining together very fine wires 12 in a lattice fashion. More specifically, the wire matrix 14 is disposed on the ejection surface side of a liquid chamber 16 which stores ink liquid, and intersection points (lattice points) 18 of the fine wires 12 function as ejection points instead of the nozzle holes.

In FIG. 1, in order to simplify the diagram, an embodiment is described in which the fine wires 12 are combined in the form of a net to create a rectangular lattice shape in a mutually perpendicular fashion following the vertical direction and the horizontal direction; however, there is no limitation to the net shape (lattice shape) of the mesh. Moreover, in FIG. 1, a number of lattice points (ejection points) are omitted (reduced) for the sake of convenience; however, in an actual mist ejection head, the lattice points (wire intersection points) are arranged in a staggered configuration in which a number of lines each of which is constituted by lattice points aligned at equal spaces following the main scanning direction (the lateral direction in FIG. 1) are arranged in the sub-scanning direction (the vertical direction in FIG. 1) and the positions of the lattice points are altered between the lines in the sub-scanning direction, thereby achieving an oblique matrix-shaped arrangement of lattice points.

By adopting a matrix structure of this kind, a high density of the effective pitch (namely, the projected ejection point pitch) which is the interval between adjacent ejection points that are projected to an alignment in the lengthwise direction of the mist ejection head (in the present embodiment, the main scanning direction), is achieved.

Circular column-shaped wires having a diameter of several micrometer to several tens of micrometer are used for the fine wires 12. Preferably, the wire diameter is set to be not greater than an intended diameter of a dot formed on the recording medium.

In FIG. 1, reference numeral 20 denotes a liquid chamber partition forming member which forms a partition for a liquid chamber 16. A supply system connection port 20A for guiding ink into the liquid chamber 16 is formed in a suitable position of the liquid chamber partition forming member 20, and is connected to an ink tank via a required channel (not shown).

Figure 2:
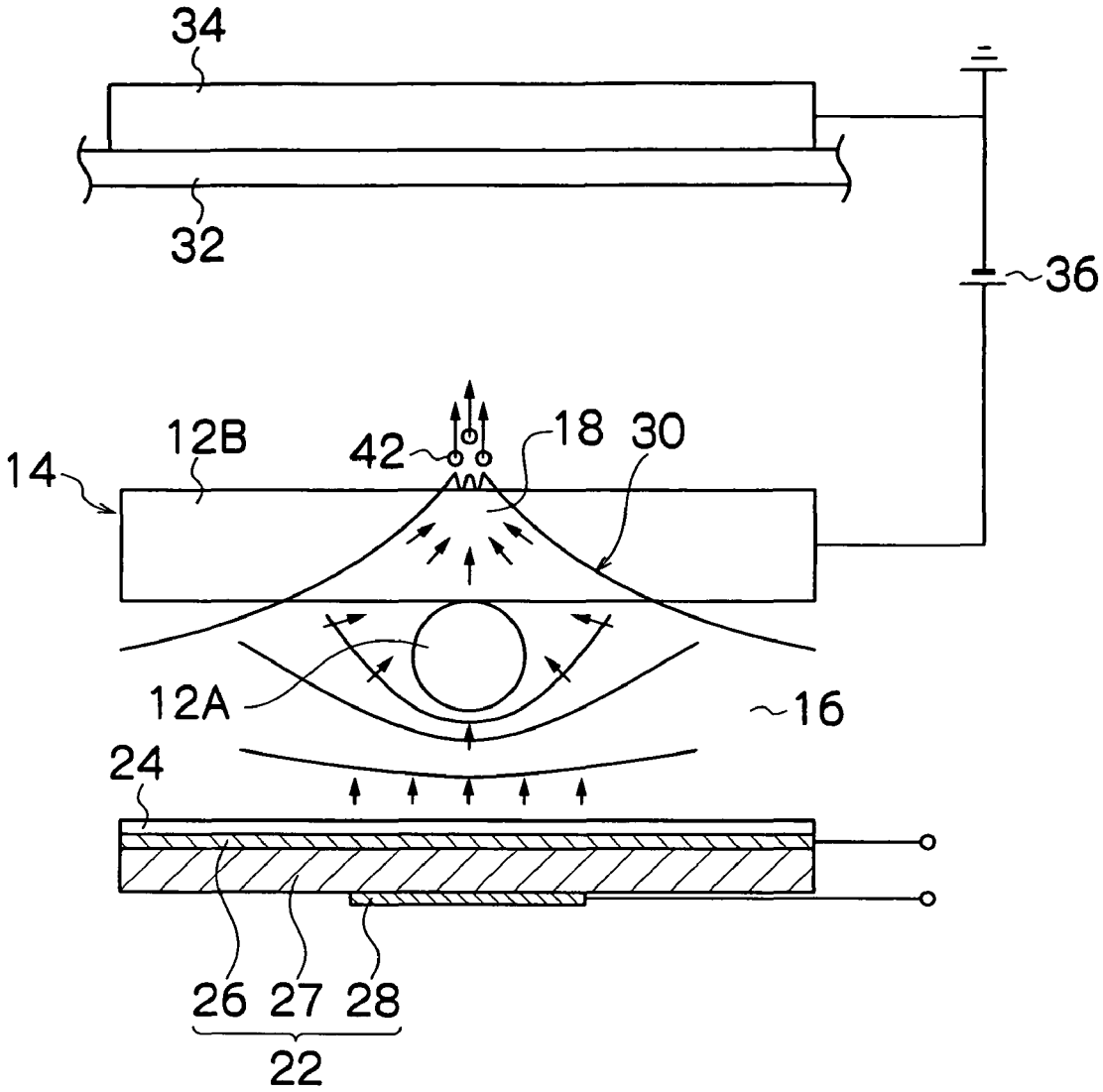
FIG. 2 is a cross-sectional diagram of a liquid droplet ejection element for one channel.
Figure 3:
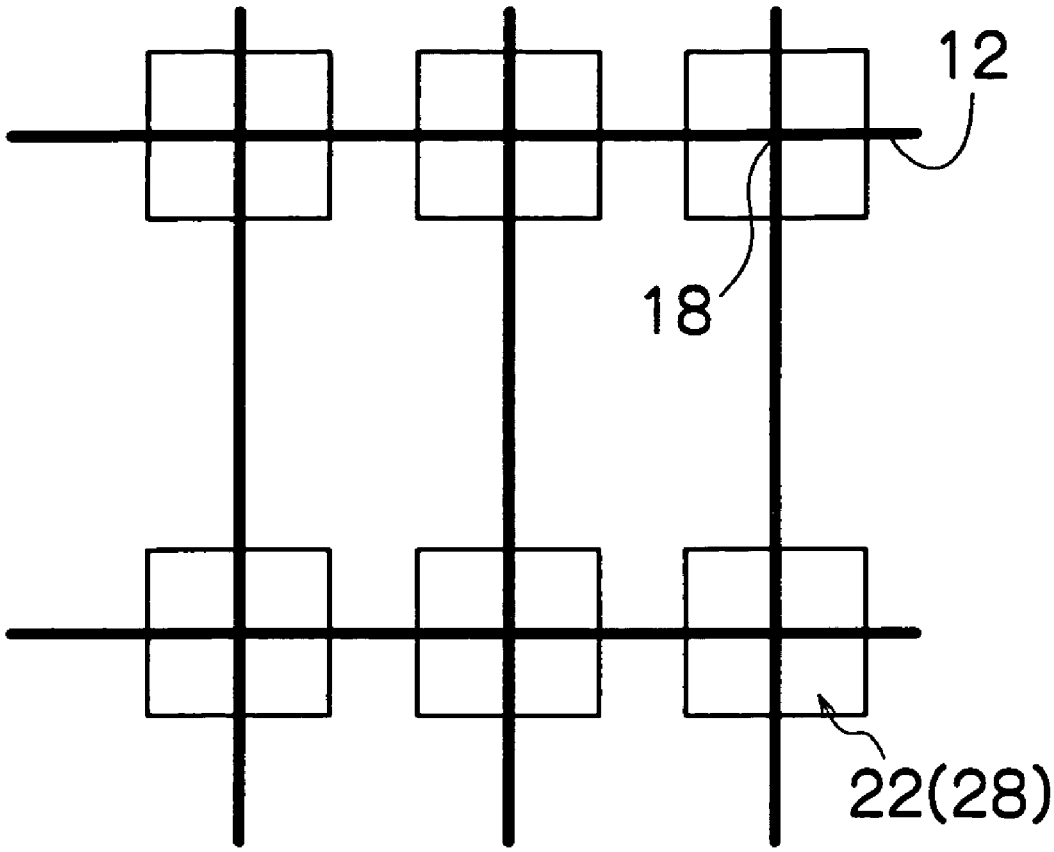
FIG. 3 is a perspective plan diagram showing an enlarged view of principal parts in FIG. 1.

FIG. 2 is a cross-sectional diagram showing a liquid droplet ejection element corresponding to one channel (a liquid droplet ejection element forming a recording element unit corresponding to one intersection point), and FIG. 3 is a diagram showing a principal enlarged view of the mist spraying apparatus shown in FIG. 1. As shown in FIGS. 1 to 3, piezoelectric elements 22 each serving as a vibrator (corresponding to an "ultrasonic wave generating device") are disposed in positions opposing the intersection points 18, on the rear side of the intersection points 18 of the fine wires 12 (on the lower side in FIG. 2). It is preferable to adopt a composition in which piezoelectric elements 22 are arranged in such a manner that the center of vibration of each piezoelectric element 22 is superimposed on the position of the corresponding intersection point 18, when viewed from the direction of ejection.

As shown in FIG. 2, the piezoelectric elements 22 are joined to a diaphragm 24 on the rear surface side of the diaphragm 24 (the side opposite to the surface facing the wire matrix 14, that is to say, the lower surface side in FIG. 2). A common electrode 26 (an electrode layer) made of conductive material, such as metal, is formed on the rear surface side of the diaphragm 24 made of a resin film having insulating properties.

A layer of a piezoelectric body 27 is arranged on the common electrode 26, and each individual electrode 28 is formed on the lower surface of the piezoelectric body 27 (the surface on the opposite side from the surface being in contact with the common electrode 26). A piezoelectric material, such as lead titanate zirconate or barium titanate, is suitable for the piezoelectric body 27.

The individual electrodes 28 are driving electrodes which are provided for liquid droplet ejection elements respectively and individually, and they demarcate active regions of the piezoelectric body 27. Thus, the piezoelectric elements 22 are each constituted by an individual electrode 28, a common electrode 26 opposing the individual electrode 28, and a piezoelectric body 27 interposed between these two electrodes.

The substantially square-shaped piezoelectric elements 22 shown in FIG. 3 denote the active regions of the piezoelectric body based on the shape of the individual electrodes 28. The planar shape of the piezoelectric elements 22 corresponding to the intersection points 18 is not limited to a square shape shown in FIG. 3, and various other shapes are available, such as a quadrilateral shape including a rectangular shape and a rhombic shape, a hexagonal shape, an octagonal shape and other polygonal shape, a circular shape and an elliptical shape, and the like.

Moreover, in a composition described above with reference to FIGS. 2 and 3, the piezoelectric body layer of piezoelectric elements 22 is formed as a single body (single plate) and is not separated for each of liquid droplet ejection elements, and the individual electrodes 28 are formed in a separated fashion (by patterning them into element units). Thereby, a plurality of piezoelectric elements 22 in which the regions of the piezoelectric body that corresponds to the individual electrodes 28 are used as active sections, are provided. However, it is also possible to adopt a structure in which piezoelectric bodies and individual electrodes are individually separated with respect to each liquid droplet ejection element, thereby constituting piezoelectric elements.

As shown in FIG. 2, a space for the liquid chamber 16 which stores ink is provided between the wire matrix 14 formed by the fine wires 12, and the diaphragm 24. The whole of the free surface 30 of the ink which is supplied to the liquid chamber 16 through the ink supply path (not shown), is held (clipped) by the fine wires 12 because of the surface tension. When the piezoelectric elements 22 are not driven, each wire 12A on the lower side in FIG. 2 is situated below the liquid surface. On the other hand, each wire 12B on the upper side is disposed above the liquid surface and is exposed to the atmosphere.

A recording medium (corresponding to the "ejection receiving medium") 32, which is typically a recording paper, is conveyed while keeping a uniform distance from the ejection surface of the wire matrix 14. A flat plate-shaped rear surface electrode 34 is disposed on the rear surface of the recording medium 32 (the side opposite to the recording surface on which ink droplets are deposited), and the recording medium 32 is held (supported) by the rear surface electrode 34.

An earthed rear surface electrode 34 is arranged substantially in parallel with the ejection surface of the wire matrix 14, and it functions as an opposing electrode to the charging and accelerating electrode constituted by the wire matrix 14. As shown in FIG. 2, a positive pole of a charging and accelerating power source 36 (corresponding to a "voltage application device") is connected to the wire matrix 14 to apply a prescribed DC voltage to same.

While the voltage is thus applied to the wire matrix 14, a high-frequency drive signal (drive voltage) is applied to the individual electrode 28 of the piezoelectric element 22, thereby vibrating the piezoelectric element 22 and generating an ultrasonic wave. The diaphragm 24 vibrates in conjunction with the piezoelectric element 22 because of its flexibility, and hence the ultrasonic wave is transmitted to the ink through the diaphragm 24.

Then, the ultrasonic wave which is thus transmitted is transmitted through the ink which also serves as a medium, and the wave surface thereof reaches to the rear side (the side for ejecting liquid) of a wire intersection point. When the ultrasonic wave strikes the intersection point 18 of the fine wires 12, a surface tension wave is generated and oscillated depending on the particular characteristics of the intersection point 18. Thereby, a cluster (charged mist) of positively charged minute ink droplets 42 is sprayed from the liquid surface at the intersection point 18.

The minute ink droplets 42 sprayed from the intersection point 18 are accelerated by the electrostatic force of the electric field applied between the rear surface electrode 34 and the wire matrix 14, and consequently deposited onto the recording medium 32.

Figure 4:
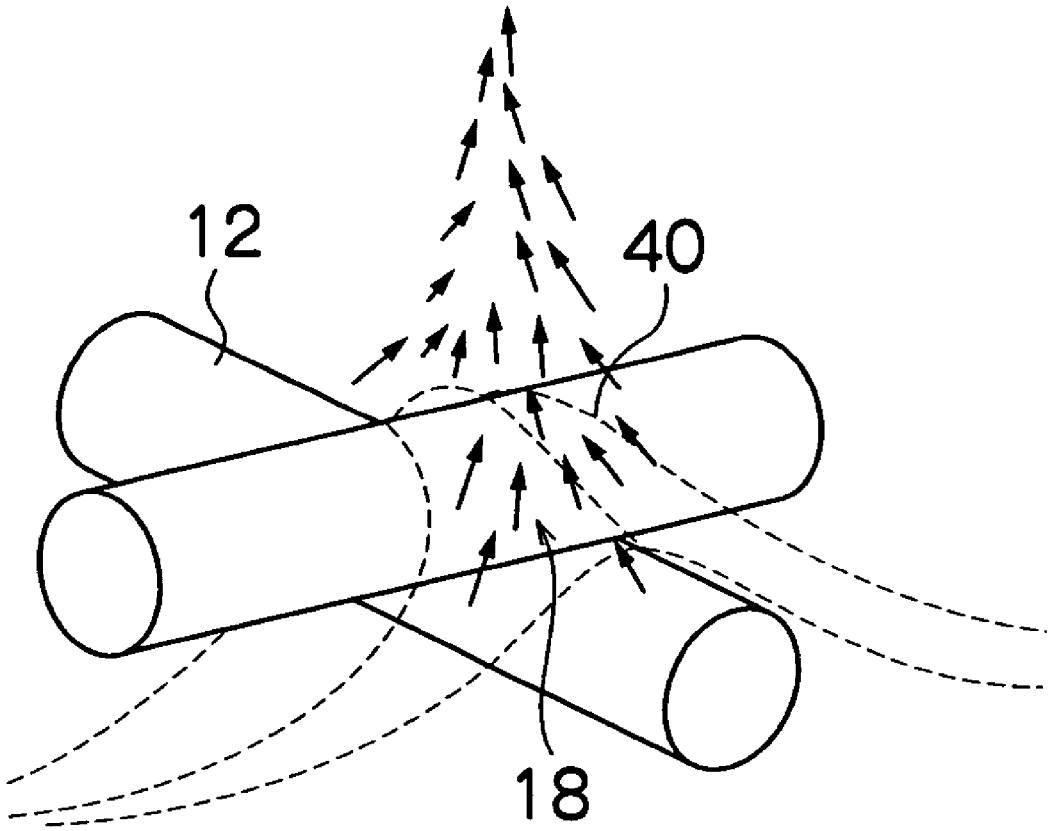
FIG. 4 is a schematic drawing showing a state of mist ejection by the intersection point ejection method based on an embodiment of the present invention.

FIG. 4 is a schematic diagram showing a state of the mist ejection. As shown in FIG. 4, due to the energy of the ultrasonic wave, a capillary wave depending on the frequency is generated at the liquid surface 40 in the region of an intersection point 18 of the fine wires 12, thereby causing fine droplets of ink separated from the minute wave peaks in the surface wave. Consequently, a group of minute droplets in the form of a mist (a mist cluster) is sprayed from the vicinity of the intersection point 18.

The vibration conditions of each piezoelectric element 22 are designed suitably in accordance with the liquid properties of the ink used. For example, each piezoelectric element 22 is made to vibrate at a frequency of 10 MHz to 100 MHz. According to the mist ejection head 10 of the present embodiment, it is possible to eject liquid having a viscosity between several millipascal-second (mPa·s) and several tens of millipascal-second, and hence it can be applied to a broad range of liquids from a general ink (an ink having a relatively low viscosity) to inks of higher viscosity (for example, inks having a viscosity of 10 mPa·s to 50 mPa·s).

According to the mist ejection head 10 having the composition described above, since the ejection region is closed (intersection point 18), rather than open (as in a circular nozzle in the related art, or the like), then it is possible to reduce variation in the ejection direction and to suppress enlargement of the dot diameter.

Moreover, there is no problem of variation in the liquid droplet size, which is an issue for a circular nozzle in the related art, and hence uniform liquid droplet size can be achieved. Therefore, by suppressing the variation of the ejection direction and the enlargement of the dot diameter, it is possible to achieve the density uniformity inside dots.

Further, since the whole ejection surface formed by the wire matrix 14 basically has an open pool structure and the free liquid surface is only supported by the wires (clipped by the wires), then it is possible to avoid enclosure of air bubbles and to achieve the good air bubble removal characteristics.

Furthermore, according to the present embodiment of the present invention, since the driving electrodes causing the ejection are arranged so as to oppose the intersection points 18 and liquid droplet ejection is performed by the driving electrodes, then it is possible to achieve the single-row density in the main scanning direction which is equal to the intersection point density at maximum. Here, the term "driving electrode" means an electrode for driving a piezoelectric member in which a simple piezo (PZT) plate is used as an actuator for a vibration mode (d33) in a thickness direction, and the electrode denoted by the reference numeral 28 in the embodiment shown in FIG. 2 corresponds to the driving electrode.

As described above, by arranging the driving electrodes appropriately, it is possible to eject liquid droplets from anywhere in the intersection points 18, and therefore the density can be increased.

MODIFICATION EXAMPLE 1

Although cylinder-shaped fine wires 12 are described in the embodiment described above with reference to FIGS. 1 to 3, the shape of the wires is not limited to this and various other shapes, such as a prism shape, can be adopted as the shape of the wires. Furthermore, there are no particular restrictions on the way in which the wires are combined together, and it is possible to adopt a mode shown in FIGS. 2 and 3 where the wires are superimposed on each other, and to adopt a mode where a net (mesh) is formed without mutually superimposing the wires.

MODIFICATION EXAMPLE 2

Figure 5:
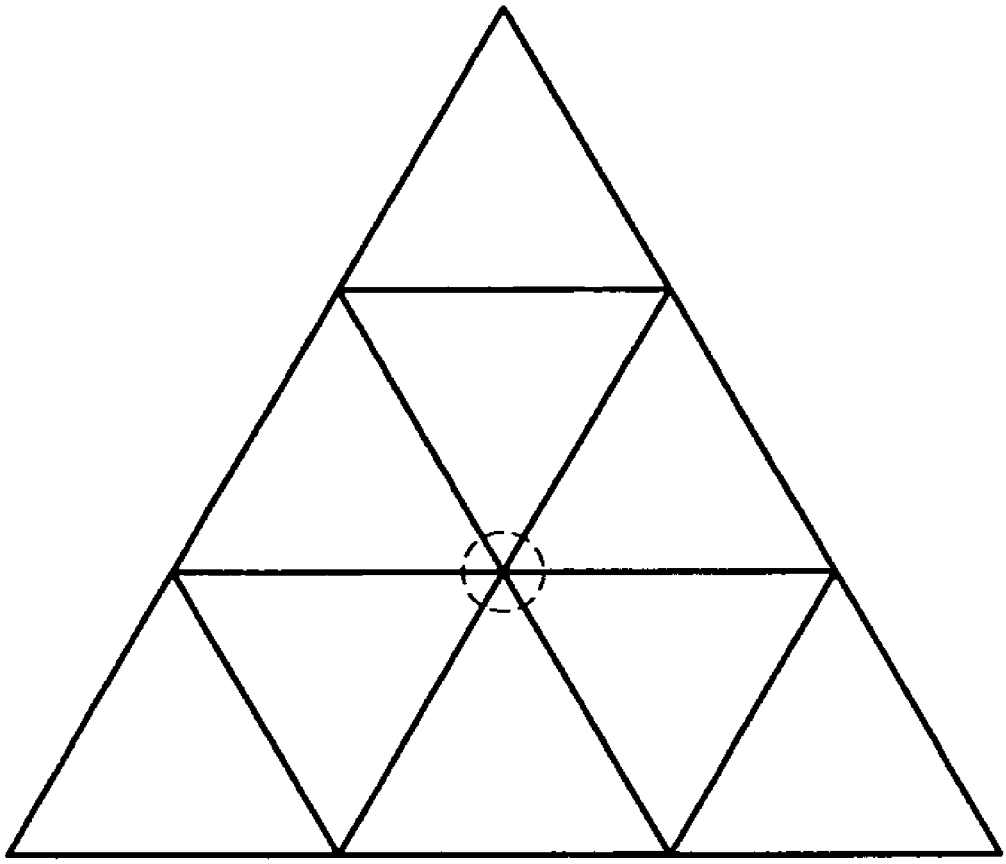
FIG. 5 is a principal schematic drawing showing a further embodiment of the wire matrix.

Although a rectangular lattice shown in FIGS. 1 to 3 is described above as an example, various other lattices are usable as the wire matrix lattice. For example, it may be a triangular lattice as shown in FIG. 5. In FIG. 5, the center of vibration of the vibrator is denoted by the dotted circle.

Structural Embodiment of Image Forming Apparatus

Next, an embodiment of an image forming apparatus in which the mist spraying apparatus described above is applied to a print head is described below.

Figure 6:
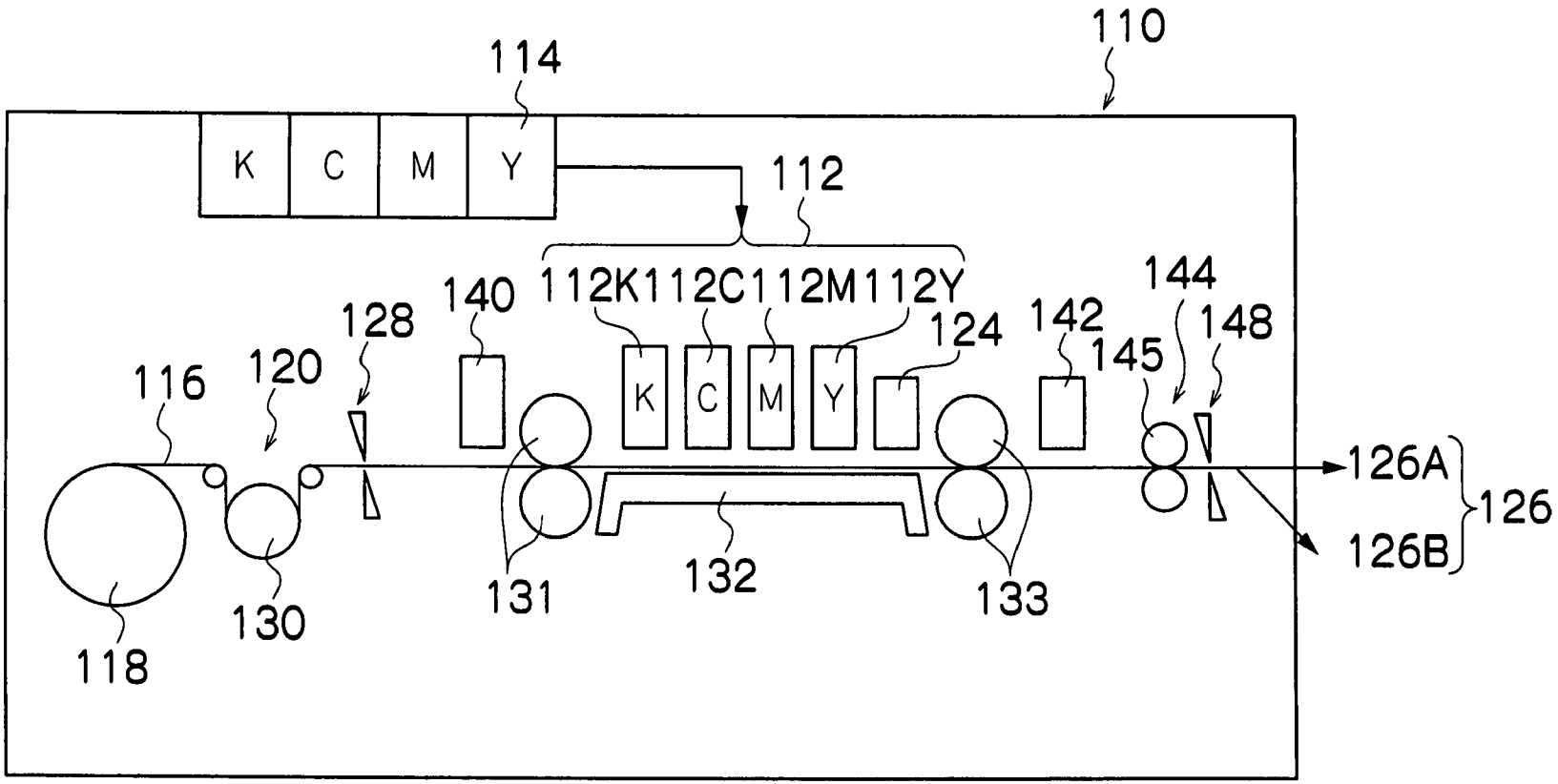
FIG. 6 is a general schematic drawing of an inkjet recording apparatus based on an embodiment of the present invention.

FIG. 6 is a general configuration diagram showing an inkjet recording apparatus according to the present invention. As shown in FIG. 6, the inkjet recording apparatus 110 comprises: a printing unit 112 having a plurality of mist ejection heads (hereafter, called "heads") 112K, 112C, 112M and 112Y provided for ink colors of black (K), cyan (C), magenta (M), and yellow (Y), respectively; an ink storing and loading unit 114 for storing inks of K, C, M and Y to be supplied to the print heads 112K, 112C, 112M and 112Y; a paper supply unit 118 for supplying a recording paper 116 which is the recording medium; a decurling unit 120 removing curl in the recording paper 116; a belt conveyance unit 122 disposed facing the ink-droplet ejection face of the printing unit 112, for conveying the recording paper 116 while keeping the recording paper 116 flat; a print determination unit 124 for reading the printed result produced by the printing unit 112; and a paper output unit 126 for outputting image-printed recording paper (printed matter) to the exterior.

The mist ejection head 10 described in FIGS. 1 to 5 is used for the heads 112K, 112C, 112M and 112Y of the print unit 112.

The ink storing and loading unit 114 has ink tanks for storing the inks of K, C, M and Y to be supplied to the heads 112K, 112C, 112M and 112Y, and the tanks are connected to the heads 112K, 112C, 112M and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 6, a single magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (medium) is used, it is preferable that an information recording medium such as a bar code and a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 6, and the continuous paper is cut into a desired size by the cutter 128. When cut papers are used, the cutter 128 is not required.

After decurling, the cut recording paper 116 is nipped and conveyed by the pair of conveyance rollers 131, and is supplied to a platen 132. A pair of conveyance rollers 133 is also disposed on the downstream side of the platen 132 (the downstream side of the print unit 112), and the recording paper 116 is conveyed at a prescribed speed by the joint action of the front side pair of conveyance rollers 131 and the rear side pair of conveyance rollers 133.

The platen 132 functions as a member (a recording medium holding device) which holds (supports) the recording paper 116 in such a manner that the recording paper 116 is kept to be flat, and it also functions as the rear surface electrode 34 shown in FIG. 2 and the like. The platen 132 in FIG. 6 has a width greater than the width of the recording paper 116, and at least the portions of the platen 132 opposing the ejection surface of the print unit 112 and the sensor surface of the print determination unit 124 form a horizontal surface (flat surface).

A heating fan 140 is disposed on the upstream side of the printing unit 112 in the conveyance pathway of the recording paper 116. The heating fan 140 blows heated air onto the recording paper 116 to heat the recording paper 116 immediately before printing so that the ink deposited on the recording paper 116 dries more easily.

Figure 7:
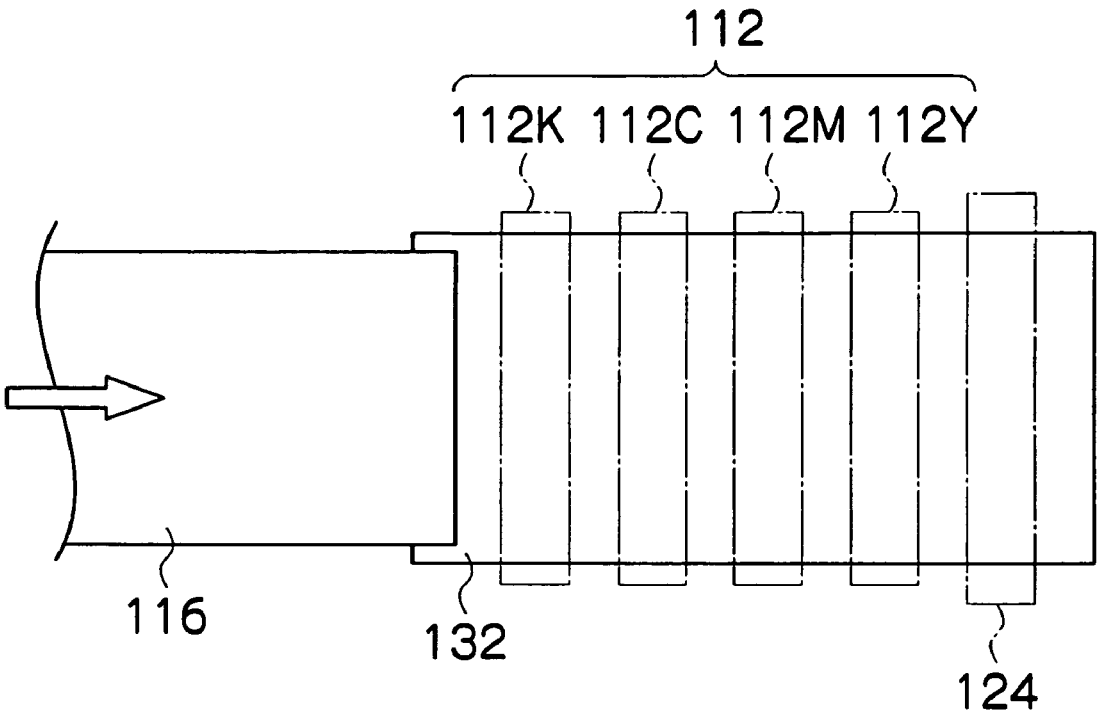
FIG. 7 is a principal plan diagram showing the peripheral area of a print unit in the inkjet recording apparatus shown in FIG. 6.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording paper (namely, the full width of the printable range) (see FIG. 7).

The print heads 112K, 112C, 112M and 112Y are arranged in color order (black (K), cyan (C), magenta (M), yellow (Y)) from the upstream side in the feed direction of the recording paper 116, and each of these heads 112K, 112C, 112M and 112Y is fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation (one sub-scanning operation) of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which heads for ejecting light-colored inks such as light cyan and light magenta are added. Furthermore, there are no particular restrictions of the sequence in which the heads of respective colors are arranged.

The print determination unit 124 shown in FIG. 6 has an image sensor (line sensor or area sensor) for capturing an image of the droplet ejection result of the print unit 112, and functions as a device to check for ejection defects such as ejection blocking positions, depositing position displacement, and the like, of the nozzles from the image of ejected droplets read in by the image sensor. A test pattern or the target image printed by the print heads 112K, 112C, 112M and 112Y of the respective colors is read in by the print determination unit 124, and the ejection performed by each head is determined. The ejection determination includes the presence of the ejection, measurement of the dot size, and measurement of the dot depositing position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming in contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 6, the paper output unit 126A for the target prints is provided with a sorter for collecting prints according to print orders.

In implementing the present invention, the lattice point arrangement structure is not limited to the embodiment shown in FIG. 1. Instead of a mode where the head is constituted by one single long head, it is possible to adopt, for example, a configuration in which a plurality of short head blocks are jointed together, thereby forming a full line head having ejection point rows extending through a length corresponding to the full width of the recording paper 116 in a direction substantially perpendicular to the conveyance direction of the recording paper 116.

Description of Control System

Figure 8:
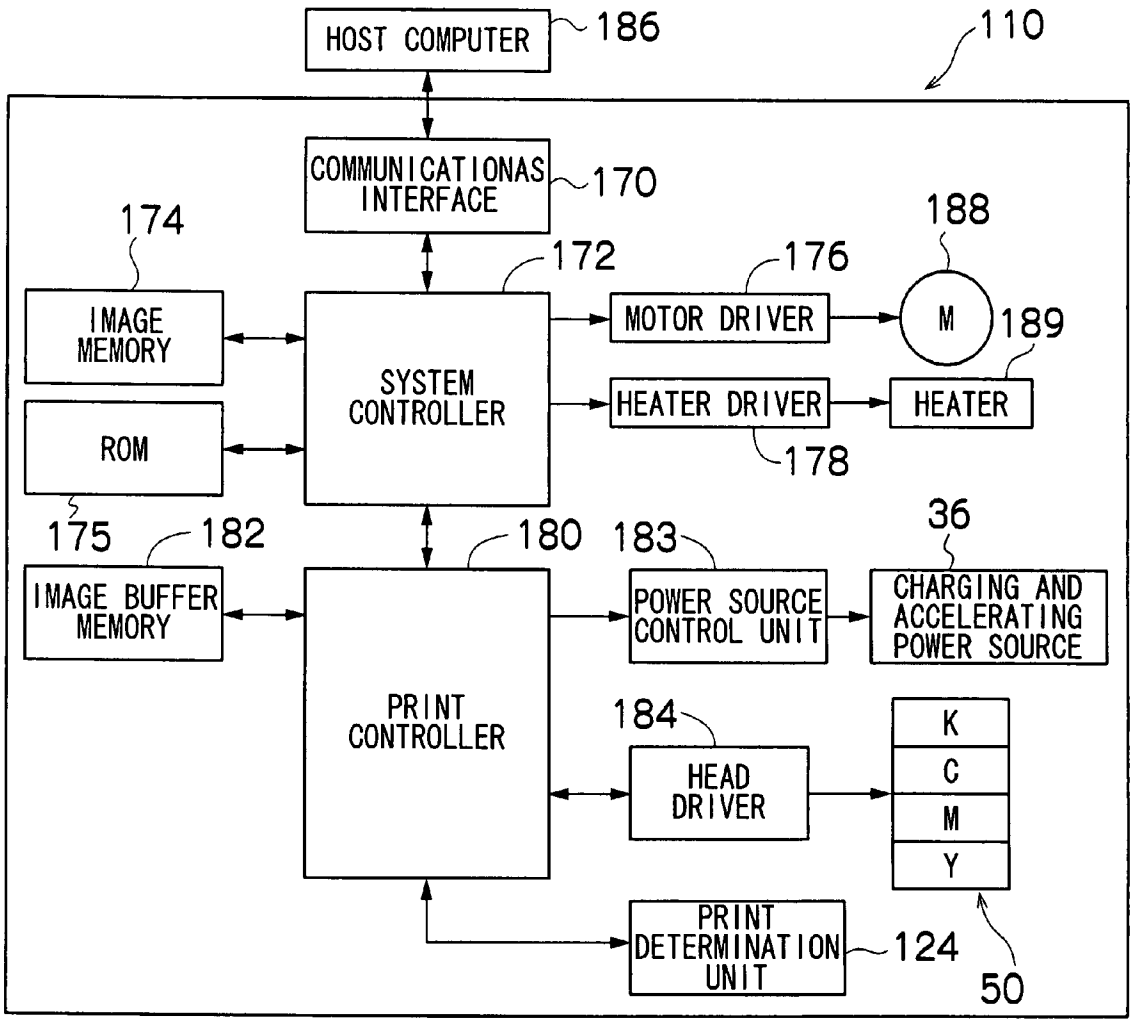
FIG. 8 is a principal block diagram showing the system composition of an inkjet recording apparatus based on an embodiment of the present invention.

FIG. 8 is a block diagram showing a system composition of the inkjet recording apparatus 110. As shown in FIG. 8, the inkjet recording apparatus 110 comprises a communications interface 170, a system controller 172, an image memory 174, a ROM 175, a motor driver 176, a heater driver 178, a print controller 180, an image buffer memory 182, a power source control unit 183, a head driver 184, and the like. In FIG. 8, the heads 112K, 112C, 112M and 112Y, of the respective colors shown in FIG. 6 are denoted by the reference numeral 150.

The communications interface 170 is an interface unit (image input device) for receiving image data sent from a host computer 186. A serial interface such as USB (Universal Serial Bus), IEEE1394, Ethernet (registered trademark), wireless network, or a parallel interface such as a Centronics interface may be used as the communications interface 170. A buffer memory (not shown) may be mounted in this portion in order to increase the communication speed.

The image data sent from the host computer 186 is received by the inkjet recording apparatus 110 through the communications interface 170, and is temporarily stored in the image memory 174. The image memory 174 is a storage device for storing images inputted through the communications interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communications interface 170, image memory 174, motor driver 176, heater driver 178, and the like, as well as controlling communications with the host computer 186 and writing and reading to and from the image memory 174 and ROM 175, and it also generates control signals for controlling the motor 188 and heater 189 of the conveyance system. The motor 188 of the conveyance system is a motor which applies a drive force to the drive rollers of the pairs of conveyance rollers 131 and 133 shown in FIG. 6, for example. Furthermore, the heater 189 in FIG. 8 is a heating device which is used in the heating drum 130, heating fan 140 or post drying unit 142, as shown in FIG. 6.

The program executed by the CPU of the system controller 172 and the various types of data which are required for control procedures are stored in the ROM 175. The ROM 175 may be a non-writeable storage device, or it may be a rewriteable storage device, such as an EEPROM. The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver 178 drives the heater 189 in accordance with commands from the system controller 172.

The print controller 180 functions as a signal processing device which generates dot data for the inks of respective colors according to the input image. More specifically, the print controller 180 is a control unit which performs various treatment processes, corrections, and the like, in accordance with the control implemented by the system controller 172, in order to generate a signal for controlling ink droplet ejection, from the image data in the image memory 174, and it supplies the print data (dot data) thus generated to the head driver 184.

The image buffer memory 182 is provided in the print controller 180, and image data, parameters, and other data are temporarily stored in the image buffer memory 182 when the image is processed in the print controller 180. In FIG. 8, the image buffer memory 182 is attached to the print controller 180; however, the image memory 174 may also serve as the image buffer memory 182. Also possible is a mode in which the print controller 180 and the system controller 172 are integrated to form a single processor.

The power source control unit 183 includes a control circuit which controls the on/off switching and the output voltage value of the charging and acceleration power source 36. The power source control unit 183 controls the output of the charging and accelerating power source 36 in accordance with commands from the print controller 180.

The sequence of processing from image input to print output is described below. Image data to be printed is input from an external source via a communications interface 170, and is accumulated in the image memory 174. At this stage, image data is stored as RGB data in the image memory 174, for example.

In this inkjet recording apparatus 110, an image which appears to have a continuous tonal graduation to the human eye is formed by changing the dot density and the dot size of fine ink dots (dots of coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180 through the system controller 172, and is converted to the dot data for each ink color by a half-toning technique, using dithering, error diffusion, or the like, in the print controller 180.

In other words, the print controller 180 performs processing for converting the input RGB image data into dot data for the four colors of K, C, M and Y. In this way, the dot data generated by the print controller 180 is stored in the image buffer memory 182.

The head driver 184 outputs drive signals, which drives the piezoelectric elements 22, for each of intersection points 18 in the head 150, on the basis of the ink dot data supplied by the print controller 180 (in other words, the ink dot data stored in the image buffer memory 182). In other words, the combination of the print controller 180 and the head driver 184 functions as a device corresponding to the "drive control device" of the piezoelectric elements 22. It is possible to incorporate a feedback control system for maintaining uniform drive conditions of the head into the head driver 184.

A prescribed voltage is applied to the ejection surface electrode of the head 150 (the wire matrix 14 shown in FIGS. 1 to 5) by the charging and accelerating power source 36, and a drive signal outputted from the head driver 184 is applied to the head 150. Thereby, ink mist is ejected from the corresponding lattice points (wire intersection points). An image is thus formed on the recording paper 116 by controlling the ink ejection from the print head 150 in synchronization with the conveyance speed of the recording paper 116.

As described above, the ejection volume and the ejection timing of the liquid droplets from the head 150 are controlled, according to the dot data generated by implementing prescribed signal processing in the print controller 180. Thus, desirable dot size and dot positions can be achieved.

The print determination unit 124 is a section that includes the image sensor described above with reference to FIG. 6, reads the image printed on the recording paper 116, determines the print conditions (presence of the ejection, variation in the dot formation, optical density, and the like) by performing a prescribed signal processing, or the like, and provides the determination results of the print conditions to the print controller 180. Instead of or in conjunction with the print determination unit 124, it is also possible to provide another ejection determination device (which corresponds with an ejection abnormality determination device).

As another ejection determination device, it is possible to adopt, for example, a mode (internal determination method) in which a pressure sensor is provided inside the head 150, and ejection abnormalities are determined from the determination signals obtained from these pressure sensors when ink is ejected, when the piezoelectric elements are driven in order to measure the pressure, or the like. Alternatively, it is also possible to adopt a mode (external determination method) using an optical determination system comprising a light source, such as laser light emitting element, and a photoreceptor element, whereby light, such as laser light, is irradiated onto the ink droplets ejected from the head 150 and the droplets in flight are determined by means of the transmitted light quantity (received light quantity).

The print controller 180 implements various corrections (correction of the ejection volume, correction of the ejection position, and the like), with respect to the print head 150, according to, if necessary, the information obtained from the print determination unit 124 or another ejection determination device (not shown).

According to the inkjet recording apparatus 110 having the composition described above, it is possible to form dots having a small dot diameter, compared to the composition in the related art, and hence an image of high resolution can be formed.

Moreover, in the foregoing explanation, the inkjet recording apparatus is described as one embodiment of an image forming apparatus, but the scope of application of the present invention is not limited to this. For example, the mist spraying apparatus according to the present invention may also be applied to a photographic image forming apparatus in which developing solution is applied onto a printing paper by means of a non-contact method. Furthermore, the scope of application of the mist spraying apparatus according to the present invention is not limited to an image forming apparatus, and the present invention may also be applied to various other types of apparatuses (such as a coating apparatus, an applying apparatus, an apparatus for drawing wiring, and the like) which spray a processing liquid (a treatment liquid), a chemical solution, or other liquid, toward an ejection receiving medium by means of a mist ejection head (spray head).

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A mist spraying apparatus, comprising:

a liquid chamber filled with liquid;

a mesh member which is disposed on a liquid ejection surface side of the liquid chamber, has a lattice shape, and retains a free surface of the liquid filled in the liquid chamber, the mesh member comprises fine wires forming a lattice shape wherein an intersection point of the wires in the mesh member is a lattice point in the lattice shape; and an ultrasonic wave generating device which is disposed at a position opposing the intersection point of the mesh member and emits an ultrasonic wave into the liquid.

2. The mist spraying apparatus as defined in claim 1, further comprising:

a rear surface electrode which supports an ejection receiving medium onto which the liquid in a form of a mist is ejected from the intersection point of the wires in the mesh member; and a voltage application device which generates an electric field to accelerate the liquid in a form of a mist toward the ejection receiving medium, in a space between the mesh member and the rear surface electrode.

3. An image forming apparatus comprising the mist spraying apparatus as defined in claim 1, wherein an image is formed on an ejection receiving medium by means of the liquid ejected from the intersection point of the mesh member.

4. The mist spraying apparatus as defined in claim 1, wherein the free surface of the liquid in an ejection surface of the mist spraying apparatus is clipped by a lattice of the mesh member due to surface tension of the liquid.

5. The mist spraying apparatus as defined in claim 1, wherein a mist cluster is sprayed from the intersection point.

6. The mist spraying apparatus as defined in claim 1, wherein the ultrasonic wave generating device is arranged in such a manner that a center of vibration of the ultrasonic wave generating device is superimposed on a position of the intersection point when viewed in an ejection direction.

7. The mist spraying apparatus as defined in claim 1, wherein a plurality of the intersection points of the fine wires being the lattice points of the lattice shape are arranged in the liquid ejection surface of the liquid chamber in a matrix fashion.

8. The mist spraying apparatus as defined in claim 1, wherein a plurality of the intersection points are arranged in a staggered configuration wherein the fine wires at each of the intersection points intersect obliquely with each other.

9. The mist spraying apparatus as defined in claim 1, wherein the lattice shape is rectangular.

10. The mist spraying apparatus as defined in claim 1, wherein the lattice shape is triangular.

11. The mist spraying apparatus as defined in claim 1, wherein a diameter of the fine wire ranges from several micrometers to several tens of micrometers.

12. The mist spraying apparatus as defined in claim 1, wherein a diameter of the fine wire is not greater than a diameter of a dot to be formed on the ejection receiving medium.

* * * * *